US006615515B1

(12) United States Patent
Wu

(10) Patent No.: US 6,615,515 B1
(45) Date of Patent: Sep. 9, 2003

(54) STEAM IRON WITH A HORIZONTAL PARTITION MOVABLE VERTICALLY WITHIN A STEAM GENERATING CHAMBER

(75) Inventor: Tsan-Kuen Wu, Tainan Hsien (TW)

(73) Assignee: Eupa International Corporation, Las Vegas, NV (US)

( * ) Notice: Subject to any disclaimer, the term of this patent is extended or adjusted under 35 U.S.C. 154(b) by 0 days.

(21) Appl. No.: 10/151,980

(22) Filed: May 21, 2002

(51) Int. Cl.[7] ..... D06F 75/40
(52) U.S. Cl. ..... 38/77.83
(58) Field of Search ..... 38/77.83, 77.8, 38/77.6, 77.3, 77.7, 77.9, 79, 85, 96; 219/242, 246, 254, 259

(56) References Cited

U.S. PATENT DOCUMENTS 4,203,026 A * 5/1980 Walter et al. ..... 219/222
4,532,412 A * 7/1985 Birocchi ..... 392/399
4,616,122 A * 10/1986 Burian et al. ..... 392/403
4,837,952 A * 6/1989 Hennuy et al. ..... 38/77.7

* cited by examiner

*Primary Examiner*—Ismael Izaguirre
(74) *Attorney, Agent, or Firm*—Ladas & Parry

(57) ABSTRACT

A steam iron includes an iron unit and an evaporating unit. The evaporating unit includes a horizontal partition that divides a steam generating chamber into upper and lower chamber portions. Water is evaporated within the lower chamber portion so as to form steam that raises the partition, thereby permitting steam flow from the lower chamber portion into the upper chamber portion.

13 Claims, 6 Drawing Sheets

STEAM IRON WITH A HORIZONTAL PARTITION MOVABLE VERTICALLY WITHIN A STEAM GENERATING CHAMBER

BACKGROUND OF THE INVENTION

1. Field of the Invention

The invention relates to a steam iron, more particularly to a steam iron that includes a horizontal partition that is movable vertically within a steam generating chamber.

2. Description of the Related Art

Referring to FIGS. 1 and 2, a conventional steam iron 1 is shown to comprise an iron unit 11 with a plurality of steam outlets 111, a base unit 12 formed with a receiving space 121, an evaporating unit 13 installed fixedly in the receiving space 121, a relief valve 14 mounted on the evaporating unit 13, and a connecting tube 15 interconnecting the evaporating unit 13 and the iron unit 11. The evaporating unit 13 includes a housing 132 that defines a steam generating chamber 131, a heating unit 133 installed on a bottom portion of the housing 132, a hollow tube 135 threadedly connected to a top portion of the housing 132, and a steam port 136 that is formed through the housing 132 and that is in fluid communication with the steam generating chamber 131. The tube 135 has a water inlet 134 that is in fluid communication with the steam generating chamber 131. The relief valve 14 is threadedly connected to the tube 135. The connecting tube 15 is disposed above and is in fluid communication with the steam port 136. The iron unit 11 further includes a steam switch 112, which can be pressed to control the release of steam from the steam outlets 111.

In use, the relief valve 14 is rotatably opened to permit filling of water into the steam generating chamber 131 via the water inlet 134 in the tube 135. The heating unit 133 is activated after the relief valve 14 is threadedly mounted on the threaded tube 135 to vaporize the water in the steam generating chamber 131. When steam is needed, the steam switch 112 is pressed such that the steam flows from the steam port 136 into the iron unit 11 via the connecting tube 15, thereby exiting from the steam outlets 111.

The following are some of the drawbacks of the conventional steam iron 1:

1. Because the volume of the evaporating unit 13 is relatively large, it is time-consuming to vaporize the water in the steam generating chamber 131. Furthermore, when water is refilled into the steam generating chamber 131, the temperature of the evaporating unit 13 is lowered, thereby prolonging the heating time.
2. Since steam is accumulated in the evaporating unit 13 and is released through the relief valve 14, it may result in injury, such as scalding, to the user. The conventional steam iron 1 is thus unsafe.

SUMMARY OF THE INVENTION

Therefore, the main object of the present invention is to provide a steam iron with an evaporating unit that can generate steam rapidly.

Another object of the present invention is to provide a steam iron that is safe to use.

According to this invention, a steam iron comprises an iron unit, an evaporating unit, a water reservoir, and a connecting tube. The iron unit includes a soleplate and a plurality of steam outlets in the soleplate. The evaporating unit includes a thermally conductive housing, a horizontal partition, and a heating unit. The housing has a pair of upper and lower halves interconnected fixedly to confine a steam generating chamber therebetween. The lower half is formed with a water inlet. The upper half is formed with a steam port that is in fluid communication with the steam generating chamber. The horizontal partition is mounted movably in the steam generating chamber so as to divide the steam generating chamber into upper and lower chamber portions. The upper chamber portion is disposed over the partition, and is in fluid communication with the steam port in the upper half. The lower chamber portion is disposed under the partition; The partition is disposed at a sealing position, where the water inlet is prevented from fluid communication with the upper chamber portion, and is movable upwardly to a release position, where the water inlet is in fluid communication with the lower chamber portion. The heating unit is provided for heating the lower half. The water reservoir is in fluid communication with the water inlet in the lower half for supply of water into the lower chamber portion of the steam generating chamber via the water inlet. Supplied water is confined within the lower chamber portion when the partition is disposed at the sealing position, and is evaporated to form steam within the lower chamber portion when the heating unit is energized so as to raise the partition to the release position, thereby permitting flow of the steam from the lower chamber portion into the steam port in the upper chamber portion. The connecting tube interconnects the evaporating unit and the iron unit so that the steam outlets in the iron unit are in fluid communication with the steam port in the upper half of the evaporating unit, thereby permitting discharge of the steam from the steam outlets in the iron unit.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
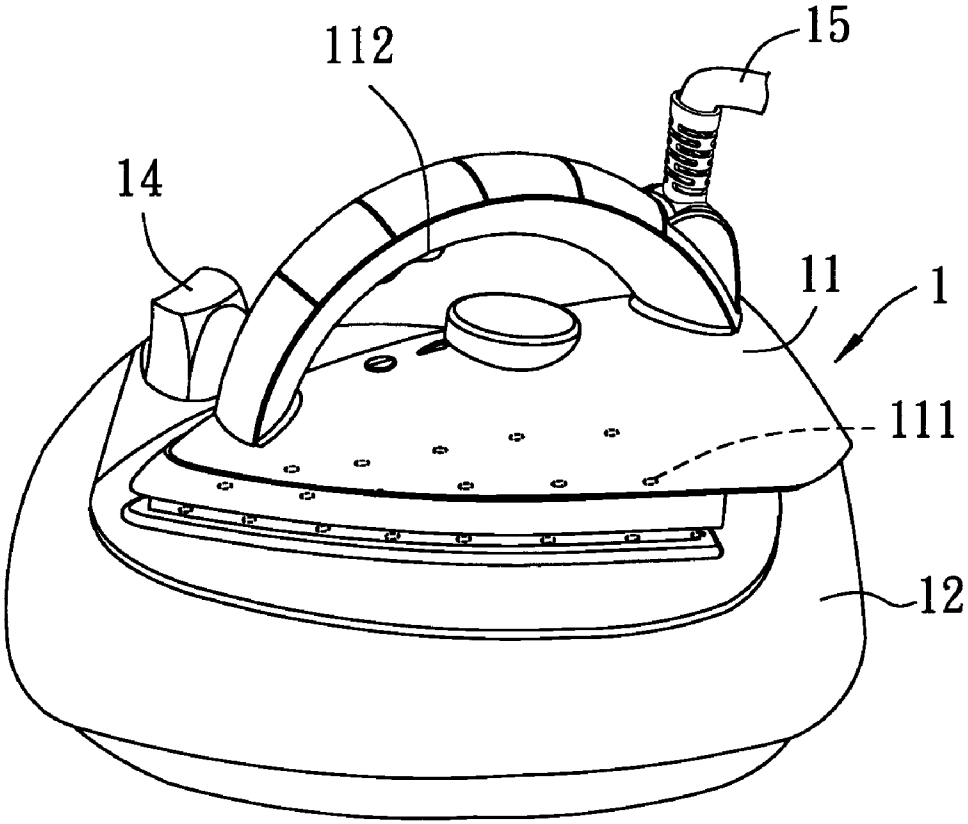
FIG. 1 PRIOR ART
FIG. 1 is a perspective view of a conventional steam iron.
Figure 2:
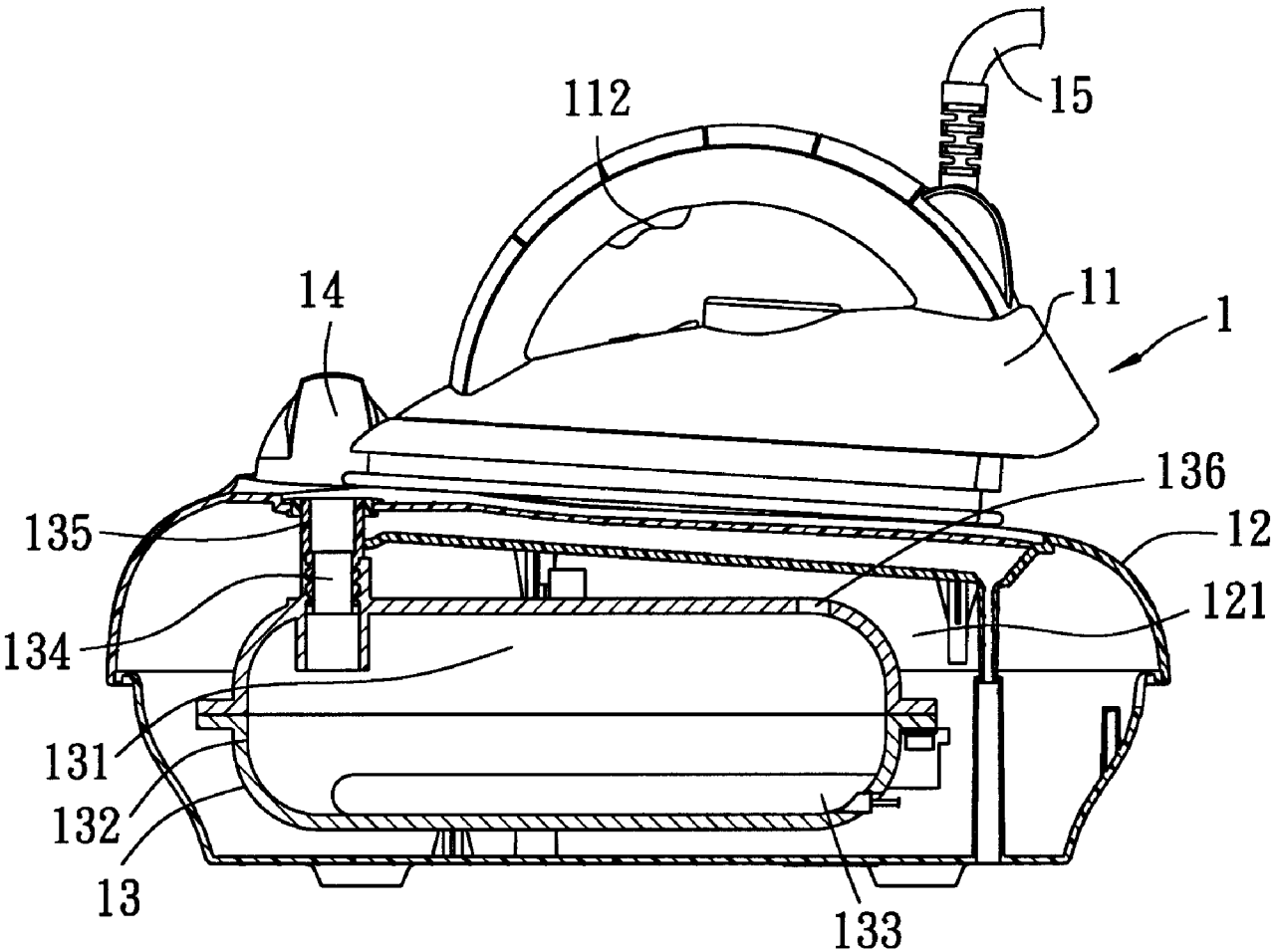
FIG. 2 PRIOR ART
FIG. 2 is a partly sectional schematic view of the steam iron of FIG. 1.
Figure 3:
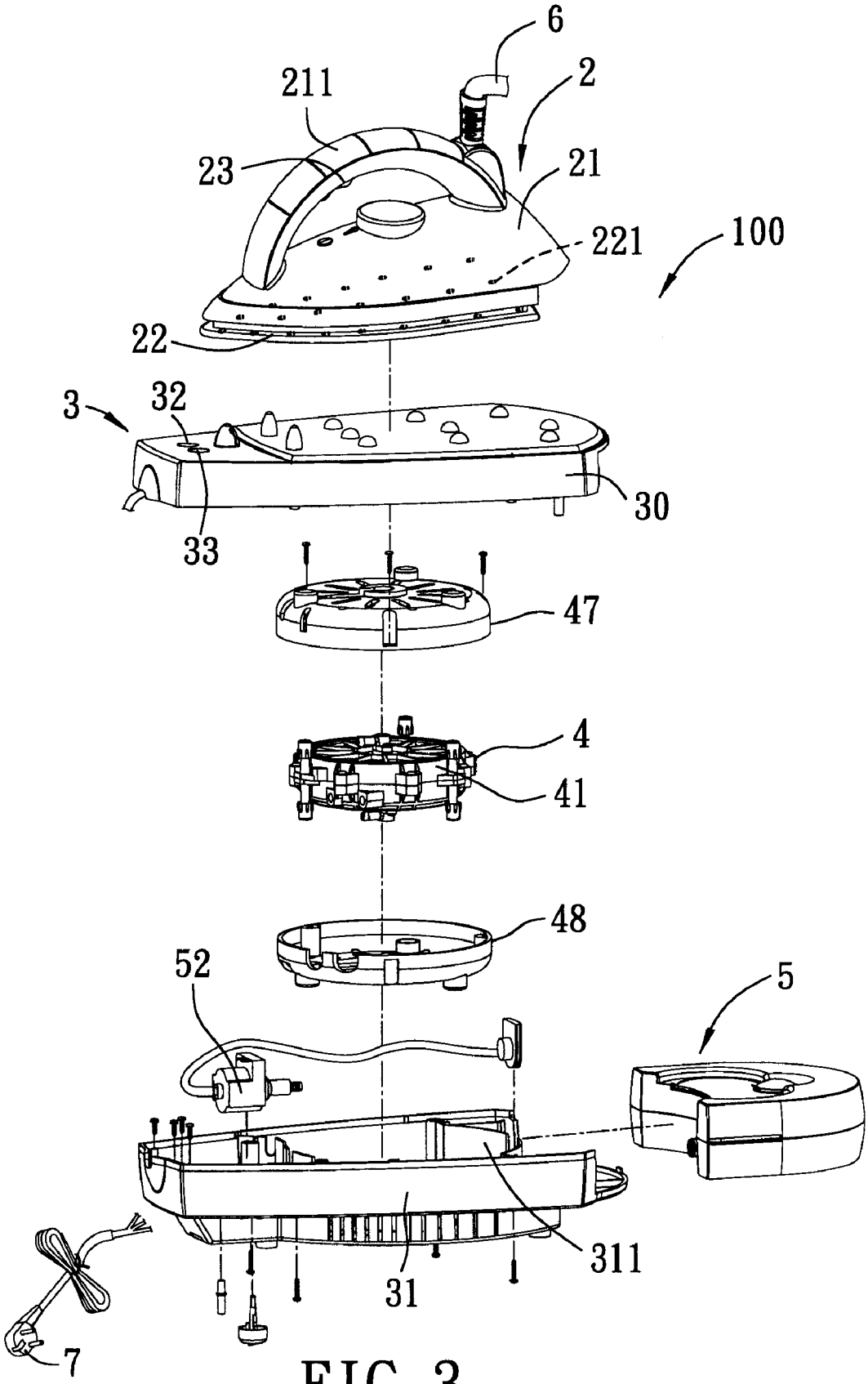
FIG. 3 is a partly exploded perspective view of the preferred embodiment of a steam iron according to the present invention.
Figure 4:
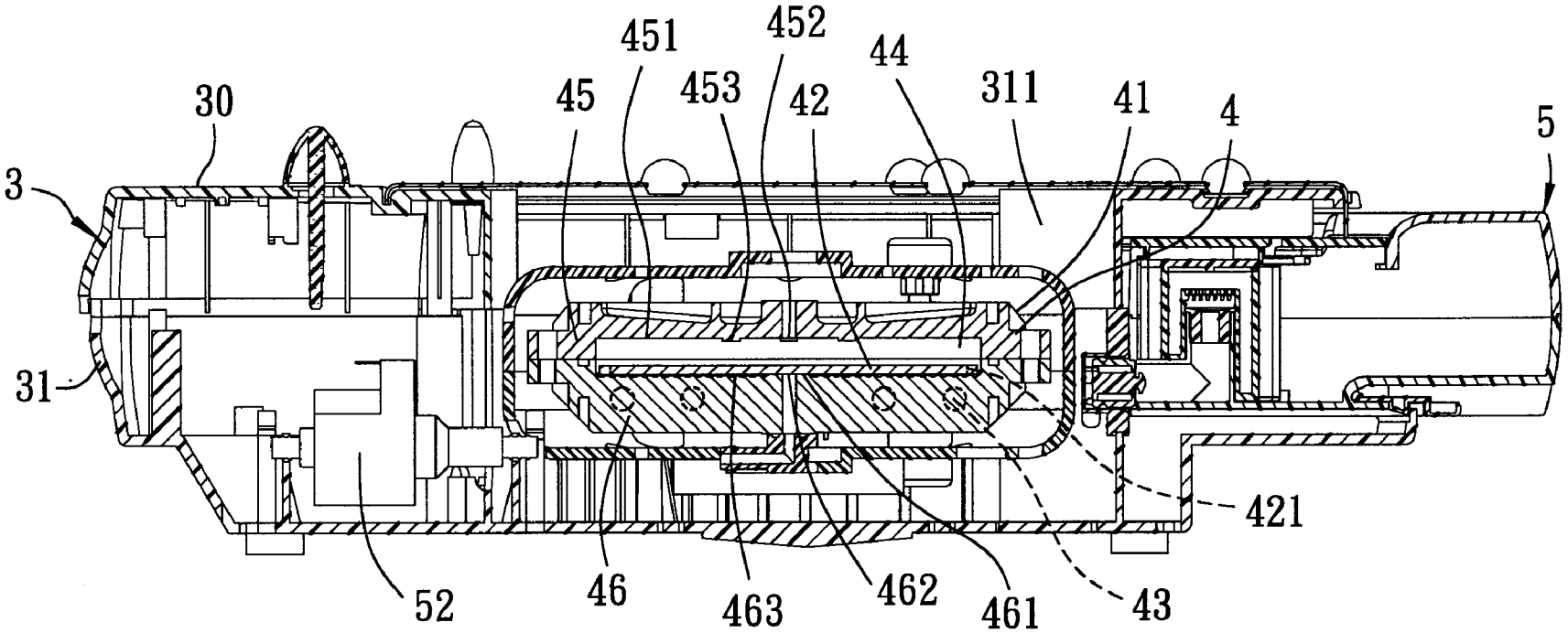
FIG. 4 is a sectional view of the preferred embodiment.

Referring to FIGS. 3 to 6, the preferred embodiment of a steam iron 100 according to the present invention is shown to comprise an iron unit 2, a base unit 3, an evaporating unit 4, a water reservoir 5, a pump unit 52, and a connecting tube 6.

The iron unit 2 includes a main body 21, a soleplate 22 installed on a bottom portion of the main body 21, a plurality of steam outlets 221 formed in the soleplate 22, and a handle 211. The handle 211 is provided with a water-filling switch 23.

The base unit 3 includes an upper base portion 30 and a lower base portion 31 that cooperate to define a receiving space 311 and that are fastened together by means of bolts. The base unit 3 is provided with an ironing switch 32 that is adapted to be electrically connected to a power plug 7 so as to heat the iron unit 2 in a known manner.

Figure 5:
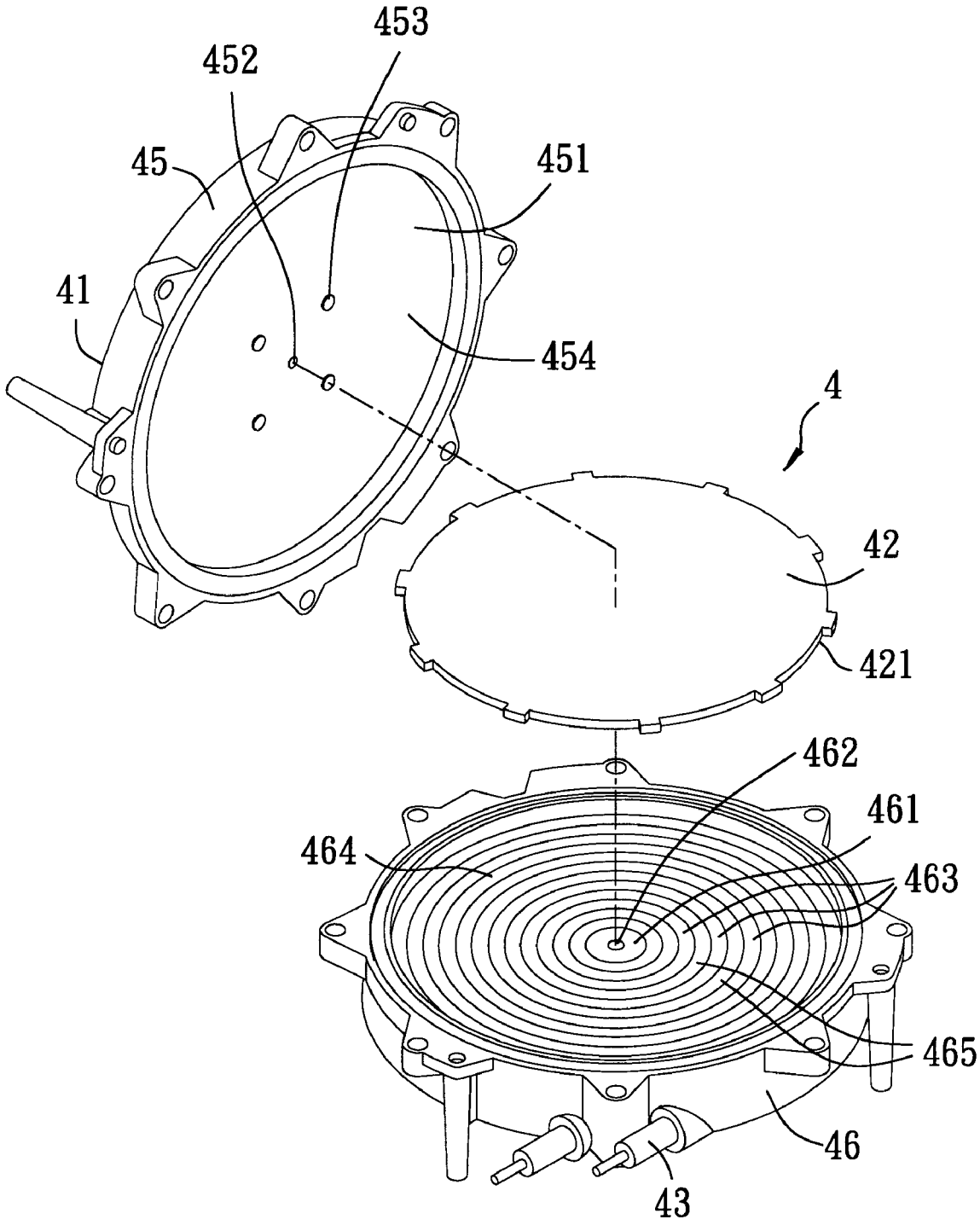
FIG. 5 is a partly exploded perspective view showing an evaporating unit of the preferred embodiment.
Figure 6:
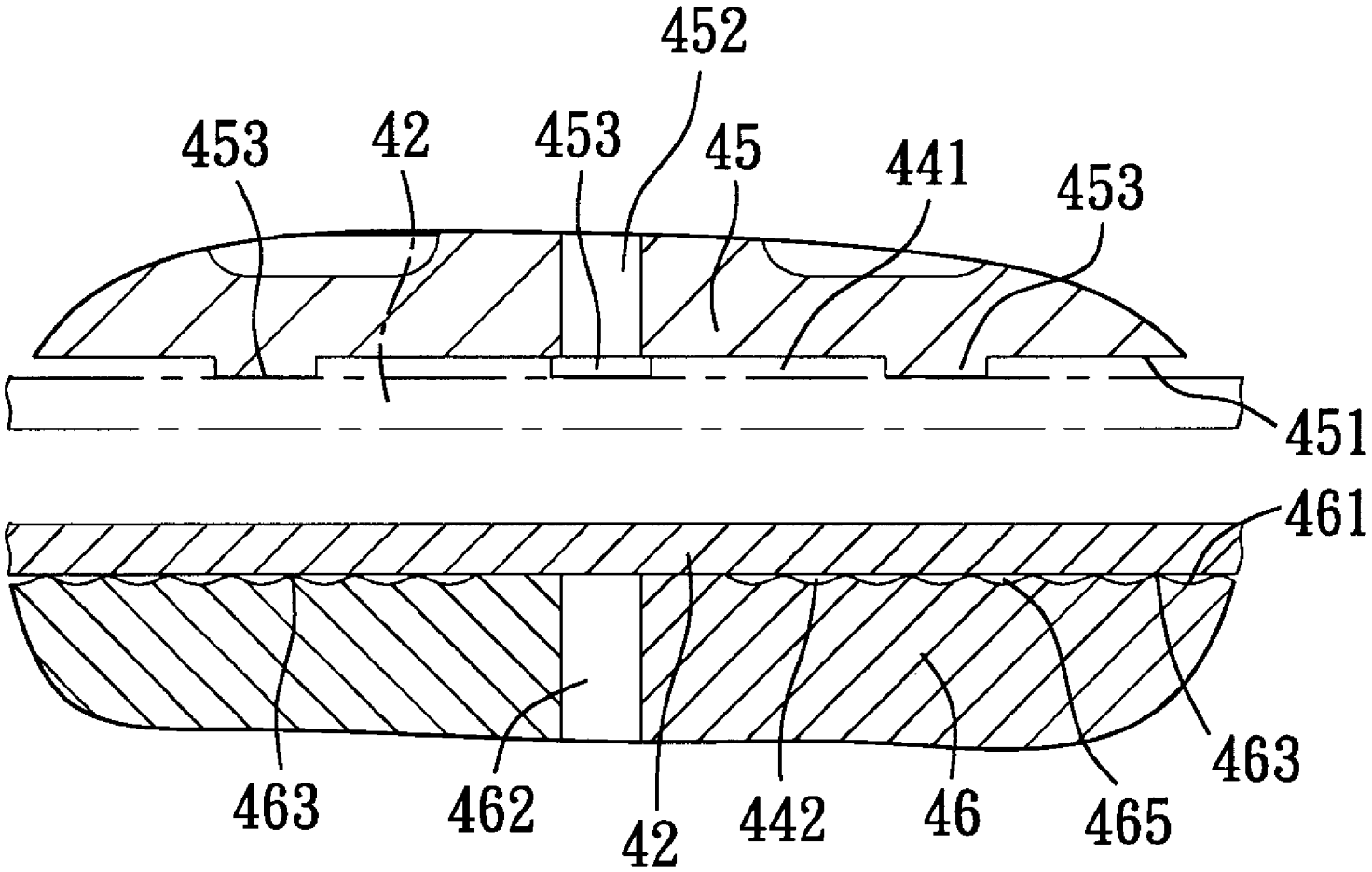
FIG. 6 illustrates how a horizontal partition of the evaporating unit is moved within a steam generating chamber between sealing and release positions.

The evaporating unit 4 is fastened to outer top and bottom covers 47, 48 by means of screws, and is concealed in the receiving space 311 in the base unit 3. The evaporating unit 4 includes a thermally conductive housing 41, a horizontal partition 42, and a heating unit 43, as best illustrated in FIG. 5. The housing 41 has a pair of upper and lower halves 45, 46 interconnected fixedly to confine a steam generating chamber 44 therebetween. The lower half 46 has a top surface that is formed with a circular recess 464, and a circular horizontal lower surface 461 that defines a bottom wall of the steam generating chamber 44 and that is formed with a water inlet 462 therein. The water inlet 462 is formed at a central portion of the lower surface 461, and is sealed by the partition 42. The lower surface 461 of the lower half 46 is formed with a rib unit to support the partition 42 thereon when the partition 42 is disposed at a sealing position shown in FIG. 4. The rib unit includes a plurality of spaced-apart, uniform-height concentric annular ribs 463, each adjacent pair of which define an annular water channel 465 therebetween. The channels 465 extend around the water inlet 462. When the partition 42 is disposed at the sealing position shown by solid lines in FIG. 6, it abuts against the ribs 463.

The upper half 45 of the housing 41 has a bottom surface which is formed with a circular recess 454 that cooperates with the circular recess 464 in the lower half 46 to form the steam generating chamber 44 so that the steam generating chamber 44 is cylindrical. The upper half 45 further has a circular horizontal upper surface 451 that defines a top wall of the steam generating chamber 44 and that is formed with the steam port 452 therein. The steam port 452 is in fluid communication with the steam generating chamber 44. The upper surface 451 of the upper half 45 is formed with a plurality of protruding posts 453 that are spaced apart from the partition 42 when the partition 42 is disposed at the sealing position and that abut against the partition 42 when the partition 42 is moved upward by water or by steam to a release position shown by phantom lines in FIG. 6. As such, the steam port 452 in the upper half 45 is prevented from being sealed by the partition 42.

The horizontal partition 42 is circular, is made of aluminum, and is mounted movably in the steam generating chamber 44 so as to divide the steam generating chamber 44 into upper and lower chamber portions 441, 442. The upper chamber portion 441 is disposed over the partition 42, and is in fluid communication with the steam port 452 in the upper half 45. The lower chamber portion 442 is disposed under the partition 42, and is in fluid communication with the water inlet 462 in the lower surface 461 of the lower half 46 when the partition 42 is moved upward to the release position. The partition 42 has a diameter that is slightly smaller than that of the recesses 454, 464 in the upper and lower halves 45, 46 of the evaporating unit 4 so as to guide vertical movement of the partition 42 within the steam generating chamber 44, a bottom surface that abuts against upper ends of the ribs 463, and an outer periphery which is formed with a plurality of notches 421 that define a plurality of steam passages between the partition 42 and the housing 41, thereby permitting flow of the steam from the lower chamber portion 442 into the upper chamber portion 441 via the notches 421 when the partition 42 is disposed at the release position. As such, the partition 42 is disposed normally at the sealing position, where the water inlet 462 is prevented from fluid communication with the upper chamber portion 441 of the steam generating chamber 44, and is movable upwardly to the release position, where the partition 42 is spaced apart from the ribs 463 so that water can flow between any adjacent pair of the channels 465 via a space between the partition 42 and the ribs 463. Water will vaporize during flow from the innermost channel 465 into the outermost channel 465.

The heating unit 43 is provided for heating the lower half 46 of the housing 41, and includes a heating element, which is embedded within the lower half 46 of the housing 41 and which extends along a helical path.

The base unit 3 is further provided with an evaporating switch 33 that is adapted to be electrically connected to the power plug 7 so as to activate the heating unit 43 of the evaporating unit 4 and that is adjacent to the ironing switch 32.

The water reservoir 5 is disposed in the receiving space 311 in the base unit 3 in proximity with the evaporating unit 4, and is in fluid communication with the water inlet 462 in the lower surface 461 of the lower half 46 of the evaporating unit 4 for supply of water into the lower chamber portion 442 of the steam generating chamber 44 via the water inlet 462. Supplied water is confined within the lower chamber portion 442 when the partition 42 is disposed at the sealing position, and is evaporated to form steam within the lower chamber portion 442 when the heating unit 43 is energized so as to raise the partition 42 to the release position, thereby permitting flow of the steam from the lower chamber portion 442 into the upper chamber portion 441 via the notches 421 in the partition 42. When water flows upward from the water inlet 462, the partition 42 can also be moved upward so as to permit flow of water and steam among the channels 465.

The pump unit 52 is electrically connected to the water-filling switch 23 of the handle 211 and is operable so as to draw the water from the water reservoir 5 into the steam generating chamber 44 via the water inlet 462.

The connecting tube 6 interconnects the evaporating unit 4 and the iron unit 2 so that the steam outlets 221 in the iron unit 2 are in fluid communication with the steam port 452 in the upper half 45 of the evaporating unit 4, thereby permitting discharge of the steam from the steam outlets 221 in the iron unit 2.

In use, after water is fed into the water reservoir 5, the ironing switch 32 and the evaporating switch 33 are switched on so as to activate the iron unit 2 and the heating unit 43. At this time, the partition 42 abuts against the ribs 463. When the steam is desired, the water-filling switch 23 is pressed to activate the pump unit 52. The water from the water reservoir 5 is drawn into the channels 463 in the evaporating unit 4 via the water inlet 462 for generation of steam. As the steam is generated in the lower chamber portion 442, the partition 42 is raised to abut against the protruding posts 453 of the upper half 45. The generated steam then flows through the notches 421 in the partition 42, the upper chamber portion 441, the steam port 452, the connecting tube 6, and the iron unit 2, and exits from the steam outlets 221.

The advantages of the steam iron 100 of the present invention can be summarized as follows:

1. The volume of the evaporating unit 4 is comparatively small since it is only necessary to heat a small but continuously supplied amount of water within the compact lower chamber portion 442 at each time.
2. Water is quickly evaporated to form steam since the volume of the evaporating unit 4 is comparatively small.

3. The steam iron 100 is safe to use since steam does not accumulate in the evaporating unit 4 but flows directly out of the steam iron 100 such that a relief valve is not required.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A steam iron comprising:

an iron unit including a soleplate and a plurality of steam outlets in said soleplate;

an evaporating unit including a thermally conductive housing having a pair of upper and lower halves interconnected fixedly to confine a steam generating chamber therebetween, said lower half being formed with a water inlet, said upper half being formed with a steam port that is in fluid communication with said steam generating chamber, a horizontal partition mounted movably in said steam generating chamber so as to divide said steam generating chamber into an upper chamber portion that is disposed over said partition and that is in fluid communication with said steam port in said upper half, and a lower chamber portion that is disposed under said partition, said partition being disposed at a sealing position, where said water inlet is prevented from fluid communication with said upper chamber portion, and being movable upwardly to a release position, where said water inlet is in fluid communication with said lower chamber portion, and a heating unit for heating said lower half;

a water reservoir in fluid communication with said water inlet in said lower half for supply of water into said lower chamber portion of said steam generating chamber via said water inlet, supplied water being confined within said lower chamber portion when said partition is disposed at said sealing position, and being evaporated to form steam within said lower chamber portion when said heating unit is energized so as to raise said partition to said release position, thereby permitting flow of the steam from said lower chamber portion into said steam port in said upper chamber portion; and a connecting tube interconnecting said evaporating unit and said iron unit so that said steam outlets in said iron unit are in fluid communication with said steam port in said upper half of said evaporating unit, thereby permitting discharge of the steam from said steam outlets in said iron unit.

2. The steam iron as claimed in claim 1, wherein said heating unit of said evaporating unit includes a heating element, which is embedded within said lower half of said evaporating unit and which extends along a helical path.

3. The steam iron as claimed in claim 1, wherein said lower half has a top surface that is formed with a circular recess, said upper half having a bottom surface which is formed with a circular recess that cooperates with said circular recess in said lower half to form said steam generating chamber so that said steam generating chamber is cylindrical, said lower half having a circular horizontal lower surface that defines a bottom wall of said steam generating chamber and that is formed with said water inlet therein, said upper half having a circular horizontal upper surface that defines a top wall of said steam generating chamber and that is formed with said steam port therein.

4. The steam iron as claimed in claim 3, wherein said lower surface of said lower half is formed with a rib unit to support said partition thereon when said partition is disposed at said sealing position, said partition being spaced apart from said rib unit when disposed at said release position.

5. The steam iron as claimed in claim 4, wherein said water inlet is formed at a central portion of said lower surface of said lower half, said rib unit including a plurality of spaced-apart, uniform-height concentric annular ribs, each adjacent pair of which define an annular water channel therebetween, said channels extending around said water inlet and being in fluid communication via a space between said partition and said ribs when said partition is disposed at said release position.

6. The steam iron as claimed in claim 5, wherein said partition is circular, and has a diameter that is slightly smaller than that of said recesses in said upper and lower halves of said evaporating unit so as to guide vertical movement of said partition within said steam generating chamber, a bottom surface that abuts against upper ends of said ribs, and an outer periphery which is formed with a plurality of notches that define a plurality of steam passages between said partition and said housing, thereby permitting flow of the steam from said lower chamber portion into said upper chamber portion via said notches when said partition is disposed at said release position.

7. The steam iron as claimed in claim 3, wherein said upper surface of said upper half is formed with a plurality of uniform-length protruding posts that are spaced apart from said partition when said partition is disposed at said sealing position and that abut against said partition when said partition is disposed at said release position so as to prevent said steam port in said upper half from being sealed by said partition when said partition is moved upward by the steam.

8. The steam iron as claimed in claim 1, further comprising a pump unit for drawing water from said water reservoir into said steam generating chamber via said water inlet.

9.The steam iron as claimed in claim 8, wherein said iron unit further includes a handle, on which a water-filling switch is provided, said water-filling switch being electrically connected to said pump unit so as to draw the water into said steam generating chamber via said water inlet when said water-filling switch is activated.

10. The steam iron as claimed in claim 1, further comprising a base unit, which includes an upper base portion and a lower base portion, between which said evaporating unit is concealed.

11. The steam iron as claimed in claim 9, wherein said base unit is provided with an ironing switch that is adapted to be electrically connected to a power supply so as to heat said iron unit, and an evaporating switch that is adapted to be electrically connected to the power supply so as to activate said heating unit of said evaporating unit.

12. The steam iron as claimed in claim 1, wherein said partition is made of a thermally conductive material.

13. The steam iron as claimed in claim 12, wherein said thermally conductive material is aluminum.

* * * * *